US006892887B2

(12) United States Patent
Rayborn

(10) Patent No.: US 6,892,887 B2
(45) Date of Patent: May 17, 2005

(54) POLYMER DRILLING BEAD RECOVERY SYSTEM AND RELATED METHODS

(75) Inventor: Jerry Rayborn, Franklinton, LA (US)

(73) Assignee: Alpine Mud Products Corp, Belle Chasse, LA (US)

( * ) Notice: Subject to any disclaimer, the term of this patent is extended or adjusted under 35 U.S.C. 154(b) by 122 days.

(21) Appl. No.: 10/361,169

(22) Filed: Feb. 10, 2003

(65) Prior Publication Data

US 2004/0154963 A1 Aug. 12, 2004

(51) Int. Cl.[7] ..... B07B 1/00
(52) U.S. Cl. ..... 209/17; 209/173; 209/317
(58) Field of Search ..... 209/13, 17, 44, 209/172, 172.5, 173, 208, 210, 250, 268, 273, 317, 724, 725; 175/66, 206

(56) References Cited

U.S. PATENT DOCUMENTS

| | | | | |
|---|---|---|---|---|
| 3,642,133 | A | | 2/1972 | Venanzetti |
| 3,975,163 | A | | 8/1976 | Gabellieri et al. |
| 4,043,773 | A | | 8/1977 | Scoggin |
| 4,113,036 | A | | 9/1978 | Stout |
| 4,192,392 | A | | 3/1980 | Messines et al. |
| 4,199,546 | A | | 4/1980 | Kirch |
| 4,296,969 | A | | 10/1981 | Willman |
| 4,463,987 | A | | 8/1984 | Berg et al. |
| 4,599,117 | A | * | 7/1986 | Luxemburg ..... 134/25.1 |
| 4,600,061 | A | | 7/1986 | Richards |
| 4,624,328 | A | | 11/1986 | Richards |
| 4,636,308 | A | | 1/1987 | Summers |
| 4,696,353 | A | | 9/1987 | Elmquist et al. |
| 4,836,302 | A | | 6/1989 | Heilhecker et al. |
| 4,909,898 | A | | 3/1990 | Padliya et al. |
| 5,080,807 | A | | 1/1992 | Carr et al. |
| 5,162,383 | A | | 11/1992 | Schoenhard |
| 5,310,282 | A | | 5/1994 | Voskamp |
| 5,320,170 | A | | 6/1994 | Huang et al. |
| 5,343,943 | A | | 9/1994 | Norris et al. |
| 5,402,851 | A | | 4/1995 | Baiton |
| 5,407,009 | A | | 4/1995 | Butler et al. |
| 5,407,974 | A | | 4/1995 | Dallmeyer |
| 5,436,384 | A | | 7/1995 | Grant et al. |
| 5,476,994 | A | | 12/1995 | Trezek |
| 5,607,016 | A | | 3/1997 | Butler |
| 5,775,442 | A | | 7/1998 | Speed |
| 5,814,230 | A | | 9/1998 | Willis et al. |
| 5,879,057 | A | | 3/1999 | Schwoebel et al. |
| 5,911,541 | A | | 6/1999 | Johnson |
| 5,934,390 | A | | 8/1999 | Uthe |

(Continued)

FOREIGN PATENT DOCUMENTS

| | | |
|---|---|---|
| EP | 0318231 | 5/1989 |
| FR | 2550103 | 2/1985 |

*Primary Examiner*—Donald D. Walsh
*Assistant Examiner*—Joseph C Rodriguez
(74) *Attorney, Agent, or Firm*—Dan M. De La Rosa

(57) ABSTRACT

A polymer bead recovery apparatus is provided comprising: a housing comprising a recovery tank having an internal cavity and an exterior surface, the recovery tank having at least one inlet and at least one outlet, the recovery apparatus having a least one circulation system for creating a force within the internal cavity of the recovery tank, the housing further comprising a walkway situated on the exterior surface of said recovery tank, the recovery tank comprising a shaker deck having a plurality of interchangeable screens and the walkway providing access to said screens, and wherein a mixture of solid particulate material, drilling fluids, polymer beads and drilled solids are separated by a first screen of the shaker deck and the remaining mixture of small materials, fluids and beads enters the recovery tank and are separated by the force created by the circulation system, the undesired small particulate materials are removed from the recovery tank and then separated and isolated by a second screen of the shaker deck and then the polymer beads are isolated and then recovered and collected.

18 Claims, 4 Drawing Sheets

U.S. PATENT DOCUMENTS 5,996,484 A 12/1999 Reddoch
6,138,834 A 10/2000 Southall
6,150,498 A 11/2000 Abel, Jr. et al.
6,279,471 B1 8/2001 Reddoch
6,322,693 B1 11/2001 Southall
6,533,946 B2 * 3/2003 Pullman ..... 210/787
6,553,901 B2 4/2003 Reddoch
6,585,115 B1 * 7/2003 Reddoch et al. ..... 209/3
6,681,874 B2 * 1/2004 Risher et al. ..... 175/66
2004/0069536 A1 * 4/2004 Cowan ..... 175/66

* cited by examiner

POLYMER DRILLING BEAD RECOVERY SYSTEM AND RELATED METHODS

BACKGROUND OF THE INVENTION

1. Field of the Invention

This invention relates to a polymer bead recovery apparatus comprising: a housing comprising a recovery tank having an internal cavity and an exterior surface, the recovery tank having at least one inlet and at least one outlet, the housing further comprising a walkway situated on the exterior surface of the recovery tank, the recovery tank comprising a shaker deck having a plurality of interchangeable screens and being situated above the internal cavity of the recovery tank, and the walkway providing access to the screens, and the recovery tank having a collection vessel under or situated adjacent to the rig shaker screens. More specifically, the present invention relates to a method of recovering polymer beads using a low profile recovery apparatus having an internal cavity, interchangeable screens situated above the cavity, a collection vessel and a circulating system for creating turbulence within the cavity and isolating and then recovering polymer beads from a mixture of solid particulate material, drilling or separating fluids, polymer beads and drilled solids.

2. Description of the Related Art

During the drilling of a well, it is commonplace to process the drilling mud returns to remove undesired drilling cuttings or solids and to recovery polymer beads using shale shakers or the like. The shale shaker has been the primary piece of equipment, which separates the drilling solids from the mud. It is also desired to produce mud with a low drilled solids content. By recycling the large drilled solids in the well bore, smaller sizes of drilled solids are produced and thereby build up the solids content of the mud. As the solids content increases, the mud must be thinned by adding additional water which necessitates the addition of more weighting material to maintain the mud at its desired weight.

In addition to removing undesired drilled solids and producing a mud with a low drilled solids content, it is also desirable to recover and recycle drilling fluid and polymer beads. The polymer beads are usually circulated through the system once or twice and then discarded with the drilled cuttings. It is economically beneficial to recycle these potentially costly fluids and beads during the drilling process. It is conventional to screen mud over a shale shaker having screens ranging in size from 10 to 200 mesh. Therefore, any solid particulate materials having a particle size larger than the shale shaker screen would be removed from the system with the drilled solids.

There have been efforts to deposit drilled solids and polymer beads into a tank containing a liquid with a specific gravity less than the specific gravity of drilled solids but greater than the specific gravity of the polymer beads. As a result, the beads will migrate or float to the top of the tank and the drilled solids will submerge or sink to the bottom of the tank. The beads may then be skimmed from the top of the tank. In these systems, the flotation liquid in the tank requires an aqueous solution of sodium carbonate or any number of soluble salts such as sodium chloride or calcium chloride to induce the separation of beads, liquid and drilled solids. The introduction of the more efficient shale shakers that produce finer solids has made this flotation system ineffective. This flotation system did not anticipate the problem of fine solids building up in the separating fluid zone. As these solids continue to build up, the separating liquid becomes extremely viscous or thick and will not allow the beads to be effectively separated from the drilled cuttings or solids. Furthermore, the sodium carbonates on the surface of the beads, which are returned to the drilling fluid, create a problem for the drilling fluid known as carbonate contamination. Carbonate contamination produces carbonic acid, which reacts with the alkaline products in the drilling fluid, which in turn reduces the effectiveness of the drilling fluid thinners such as lignosulfonates and allow the drilling fluids to become increasingly thick and unacceptable.

There are also complicated systems, which at minimum, requires a shale shaker, a recovery tank with a hydrocyclone manifold system and a recovery shaker. In such systems, the shale shaker is mounted several feet above the recovery tank. These systems require to be completely shut down before any changes or modification can be made during the recovery process, such as any adjustments in screen sizes, clogging, safety issues involving the adjustments, etc. The amount of equipment and space necessary to use this system also hinders the broad use of the product. These complicated systems do not teach or suggest an apparatus having interchangeable screens and a walkway to provide the user with access to the screens for safe and easy changes and adjustments. Furthermore, the system of the present invention further provides for a transfer vessel and a portable recovery apparatus that can be situated at any desired location, as opposed to having to be located adjacent to or below the shale shaker. The apparatus of the present invention relates to a low profile design that provides the user with mobility and portability in the field of polymer bead recovery technology.

The system and apparatus of the present invention does not require a bulky shale shaker and removes the large solid particulate materials and drilled solids before the mixture enters the recovery tank, which is usually the main cause of clogging in the recovery tank and requires stopping the recovery process to fix the clogging. Besides the time and money lost during the stoppage, the exercise of cleaning the clogs in the recovery tank has become a major injury and safety hazard.

SUMMARY OF THE INVENTION

In one embodiment, the present invention relates to a polymer bead recovery apparatus comprising: a housing comprising a recovery tank having an internal cavity and an exterior surface, the recovery tank having at least one inlet and at least one outlet, the housing further comprising a walkway situated on the exterior surface of the recovery tank, the recovery tank comprising a shaker deck located above the internal cavity of the recovery tank and having a plurality of interchangeable screens and the walkway providing access to the screens, the recovery tank having a collection vessel situated adjacent to or under the drilling rig shaker screens; wherein a mixture of solid particulate materials, water, drilling fluids, polymer beads and drilled solids are pumped directly over the shaker deck located inside the recovery tank. All solids larger that about 10 mesh are screened out and discarded and everything smaller than 10 mesh enters the recovery tank and being further separated by the screens and the force created by the circulating system, and the polymer beads are isolated from the drilled cuttings and then pumped to the polymer bead recovery shaker which separates the polymer beads into the drilling fluid and allows the separating fluid to return to the recovery tank.

In another embodiment, the screens comprise mesh sizes from about 10 mesh to about 200 mesh. In still another embodiment, the recovery tank shaker deck comprises at least two screens with varying screens sizes. In yet another embodiment, at least one screen has a mesh size from about 10 to about 40 mesh, and at least one screen has a mesh size from about 60 to about 200 mesh.

In still yet another embodiment, the recovery apparatus further comprises a motor control panel. In a further embodiment, the recovery tank further comprises an opening at the top portion of the tank leading to the internal cavity. In a further embodiment, the shaker deck is situated above and/or partially within the internal cavity of the recovery tank. In yet a further embodiment, the apparatus is a low profile device. For purposes of this invention, the term "low profile" is defined as an apparatus that does not require height restrictions to spot the unit. In other prior art recovery systems and designs, the primary shale shaker is mounted several feet above the recovery tank and thus, the unit has tremendous height. The present invention does not require the primary shale shaker to be mounted above the recovery tank and with the transfer vessel; the recovery tank can be placed in a desired location and does not have to be below or in close proximity to the drilling rig shale shaker.

In still a further embodiment, the walkway comprises a ladder having steps and a walkway and the ladder being situated on the exterior surface of the recovery tank. In still yet a further embodiment, the collection vessel comprises an outlet for retrieving and/or disposing of the components of the mixture deposited into the tank. In yet another embodiment, the collection vessel is situated at the base of the drilling rig shakers. In another embodiment, the shaker deck is situated above the internal cavity of the tank. In a further embodiment, the apparatus of the present invention is an all-inclusive primary unit where the shaker deck is attached across the entire top opening above the internal cavity of the tank.

In still another embodiment, the circulating system comprises at least one pump. In a further embodiment, the force created by said circulating system is centrifugal force. In another further embodiment, the force created by said circulating system is turbulent force.

In a further embodiment, the recovery tank comprises hydrocyclone manifold and in yet a further embodiment, the hydrocyclone manifold is situated above the second screen of the shaker deck.

In still yet a further embodiment, the present invention relates to a transfer vessel for use in recovering polymer beads, the vessel comprising: a housing having an inlet, an outlet and an internal cavity, a first conduit attached to the inlet for connecting a shale shaker from the drilling rig to said vessel, a second conduit attached to the outlet for connecting said vessel to a transfer apparatus, the transfer vessel comprising at least one pump; and wherein a mixture of solid particulate material, water, drilling fluids, polymer beads and drilled solids enters the internal cavity of the vessel after being screened over the 10 mesh screen on the shaker deck within the recovery vessel and a turbulence created by the pump initiates the separation process of the beads from the solid particulate materials and the drilled solids, and are then transferred to said recovery apparatus via the second conduit.

In still a further embodiment, the pump is connected to the transfer vessel by a third conduit. In still yet a further embodiment, the transfer vessel further comprises a stand for easy mobility of the vessel to various locations.

In another embodiment, the present invention relates to a polymer bead recovery system comprising: a transfer vessel comprising a housing having an inlet, an outlet and an internal cavity, a first conduit attached to the inlet for connecting a shale shaker from the drilling rig to the vessel, a second conduit attached to the outlet for connecting said vessel to a recovery apparatus, and the transfer vessel comprising at least one pump; and a recovery apparatus comprising a housing comprising a recovery tank having an internal cavity and an exterior surface, the recovery tank having at least one inlet and at least one outlet, the recovery apparatus having at least one device for creating a force within the internal cavity of the recovery tank, the housing further comprising a walkway situated on the exterior surface of the recovery tank, the recovery tank comprising a shaker deck, the shaker deck comprising at least two interchangeable screens and the walkway providing access to the screens; and a hydrocyclone manifold; wherein the transfer vessel transfers a mixture of solid particulate material, water, drilling fluids, polymer beads and drilled solids to the first screen of the shaker deck of the recovery apparatus and wherein large solid particulate materials and drilled solids are separated from the mixture and discarded, and the remaining mixture is then deposited into the internal cavity of the recovery apparatus and then the remaining mixture is pumped through the hydrocyclone manifold where the components of the mixture are separated by specific gravity and the force created by the hydrocyclone manifold, and an underflow and an overflow are created. The underflow is then directed on to the second fine mesh screen of the internal shaker deck and is discarded, and the overflow containing the polymer beads and separating fluid are transferred to a recovery shaker where the polymer beads are isolated and recovered.

In still another embodiment, the recovery tank further comprises at least one dump valve for disposing of drilled solids and excess recovery fluid from the base of the tank. In yet another embodiment, the recovery tank comprises at least two screens with varying screen sizes, at least one screen has a mesh size from about 10 to about 40 mesh, and at least one screen has a mesh size from about 60 to about 200 mesh. In one embodiment, the preferred screen mesh size would be a 10 mesh on the first screen and a 200 mesh size on the second screen.

In still yet another embodiment, the screens comprise mesh sizes from about 10 mesh to about 200 mesh. In a further embodiment, the recovery tank comprises a plurality of collection vessels situated at the base of the drilling rig shakers. In another further embodiment, the walkway, as a safety measure, comprises handrails and at least one ladder having steps. In yet a further embodiment, the system further comprises at least one shale shaker connected to the transfer vessel and at least one recovery shaker connected to the recovery apparatus, the system further comprising a plurality of conduits for connecting the shale shaker to the transfer vessel, and the recovery apparatus and to the recovery shaker. In still a further embodiment, the shaker deck is situated directly over the internal cavity of the recovery tank.

In another further embodiment, the present invention relates to a method for continuously recovering polymer beads from drilling fluids, fine particles of cellulose cotton seed lint, drilled solids and mixture thereof, said method comprising: providing a recovery apparatus comprising a recovery tank having an internal cavity and an exterior surface, the recovery tank having at least one inlet and at least one outlet, the recovery apparatus having a least one circulating system for creating a force within the internal cavity of the recovery tank, the housing further comprising a walkway situated on the exterior surface of the recovery tank, the recovery tank comprising a shaker deck, the shaker deck comprising at least two interchangeable screens and the walkway providing access to the screens; directing a mixture of solid particulate material, drilling fluids, polymer beads and drilled solids onto the first screen of the shaker deck in order that large solid particulate materials and drilled solids are separated from the mixture and discarded, and the remaining mixture is then deposited into the internal cavity of the recovery apparatus, and then the remaining mixture goes through the hydrocyclone manifold where the components of the mixture are separated by specific gravity and the force created by the hydrocyclone manifold thereby creating an underflow and an overflow, the underflow is directed onto the second fine mesh screen of the shaker deck and is discarded, and the overflow containing the polymer beads are transferred to a recovery shaker; and recovering the polymer beads from the recovery shaker over a fine mesh screen, preferably about 100 mesh.

In still yet another embodiment, the method further comprises recycling the transport fluid by re-depositing the transport fluids to the recovery vessel. In a further embodiment, the method further comprises reusing the recovered polymer beads with an existing mud system. In still a further embodiment, the method further comprises removing the drilled solids from said recovery apparatus and providing a container for retaining the drilled solids. In still yet a further embodiment, the method further comprises using the walkway to safely access the screens and interchanging the screens to retain desired polymer beads with specific bead sizes using screens with specific mesh sizes. In another further embodiment, the recovery apparatus further comprises a motor control panel for operating the agitation system.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessary to scale; some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
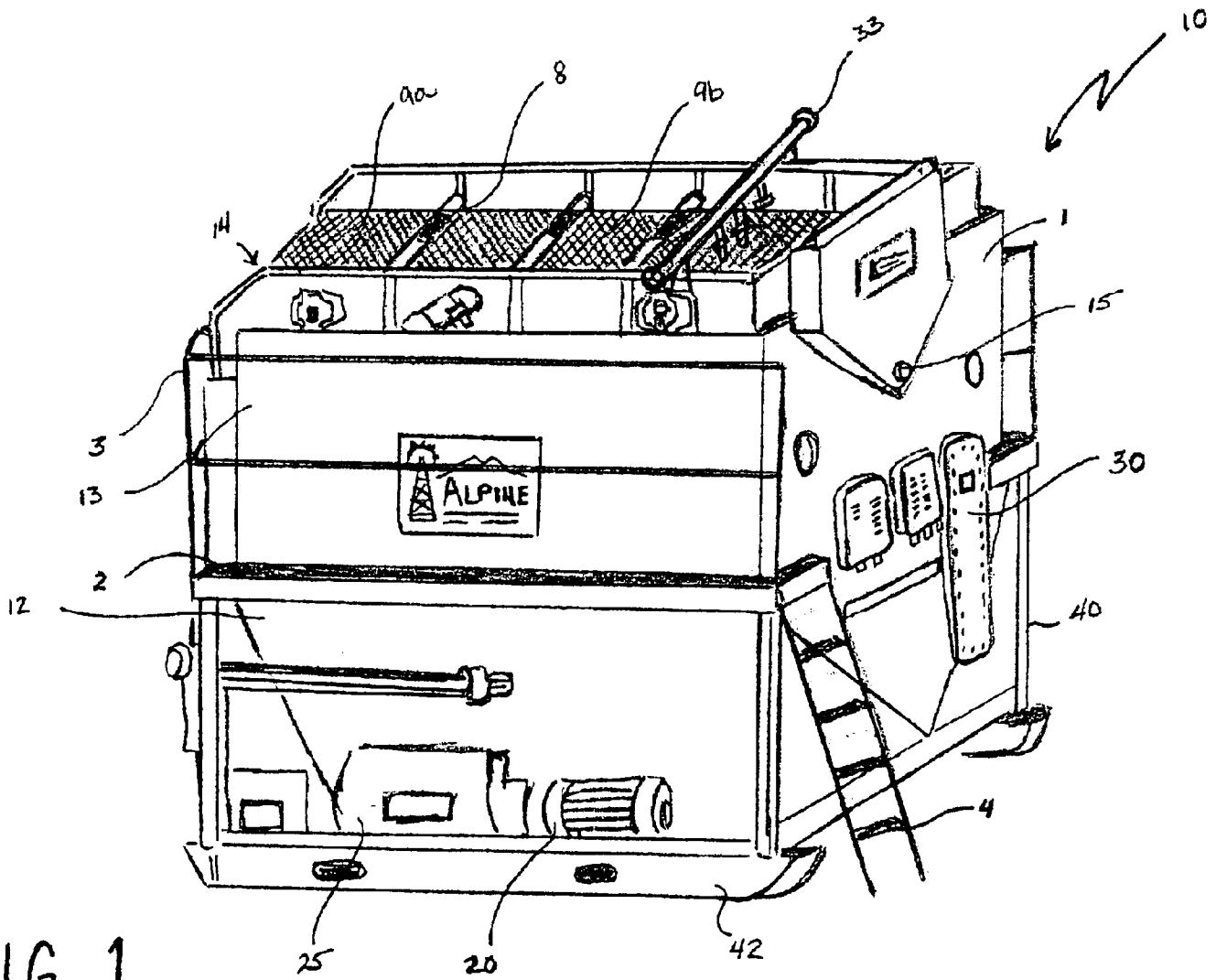
FIG. 1 is a perspective view of the recovery apparatus in accordance with the present invention.
Figure 2:
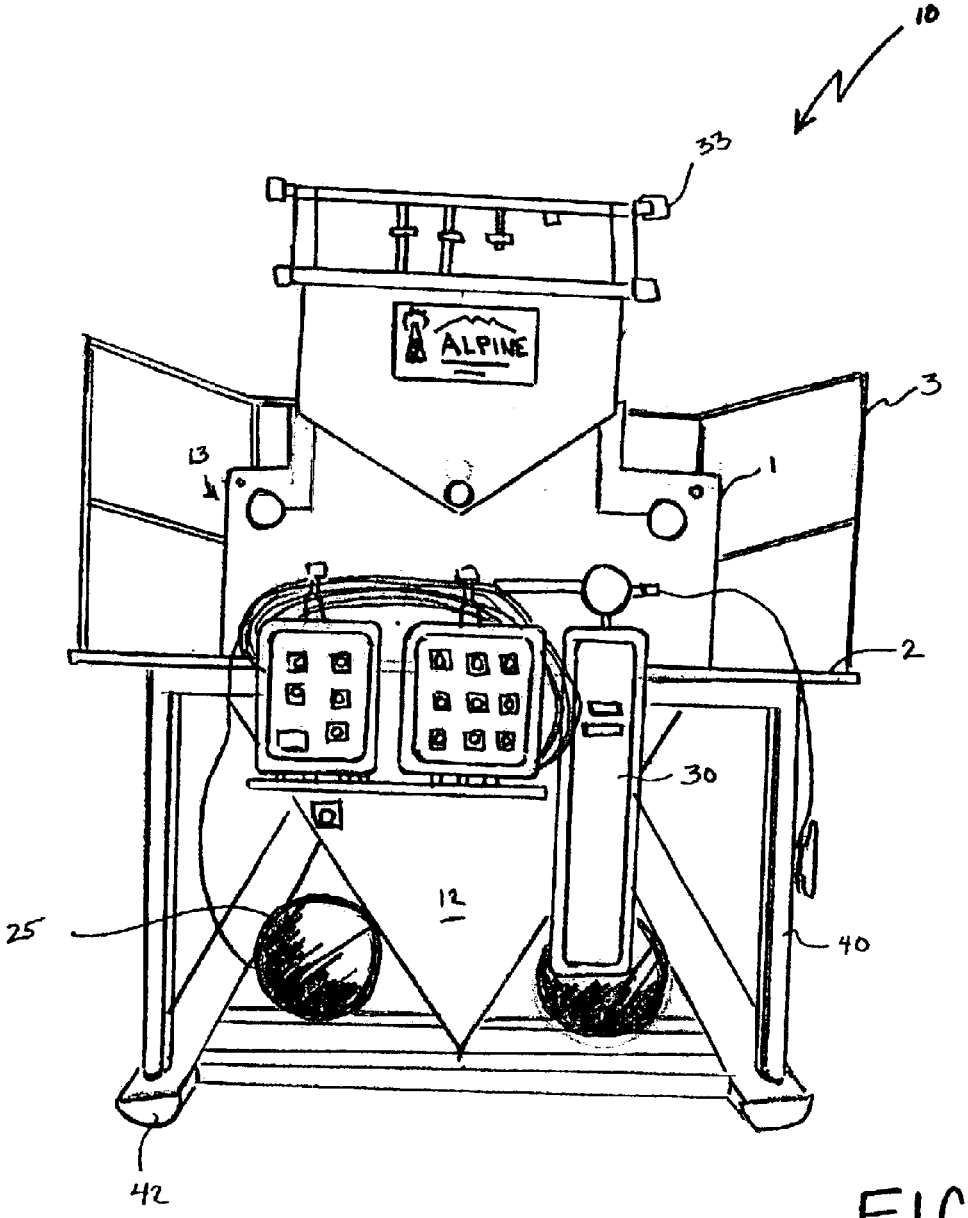
FIG. 2 is a side view of the recovery apparatus showing the hydrocyclone manifold.

Referring now to FIGS. 1–2, the present invention provides for a polymer bead recovery apparatus 10 comprising: a housing 1 comprising a recovery tank 12 having an internal cavity (not shown) and an exterior surface 13, the recovery tank 12 having at least one inlet 14 and at least one outlet 15, the recovery apparatus having at least one device 20 for creating a turbulence within the internal cavity of the recovery tank 12, the housing 1 further comprising a walkway 2 situated on the exterior surface 13 of the recovery tank 12, the recovery tank 12 comprising a shaker deck 8, the shaker deck 8 comprising a plurality of interchangeable screens 9 and the walkway 2 providing access to the screens 9; wherein a mixture of solid particulate material, water, drilling fluids, polymer beads and drilled solids enters the recovery tank 12 and are separated by the turbulence created by the device 20, and the polymer beads are isolated by the screens 9 and then recovered and collected.

The shaker deck 8 comprises at least two screens 9 with varying screens sizes; a first screen 9*a* having a mesh size from about 10 to about 40 mesh, and a second screen 9*b* having a mesh size from about 60 to about 300 mesh. The preferred mesh size on the first screen would be 10 mesh and 200 mesh o the second screen under the manifold cones.

The recovery apparatus 10 further comprises a motor control panel 30 and a recovery pump 25. The walkway 2 comprises handrails 3 and a ladder 4 with steps situated on the exterior surface 13 of the recovery tank 12. The apparatus 10 further comprises a stand 40 and a built-in skid 42 for easily transporting the apparatus 10 to the desired location. The recovery apparatus 10 also comprises a hydrocyclone manifold 33. In one embodiment, the shaker deck 8 is situated above the internal cavity of the recovery tank 12 and the hydrocyclone manifold 33 is situated over the second mesh screen 9*b*.

Figure 3:
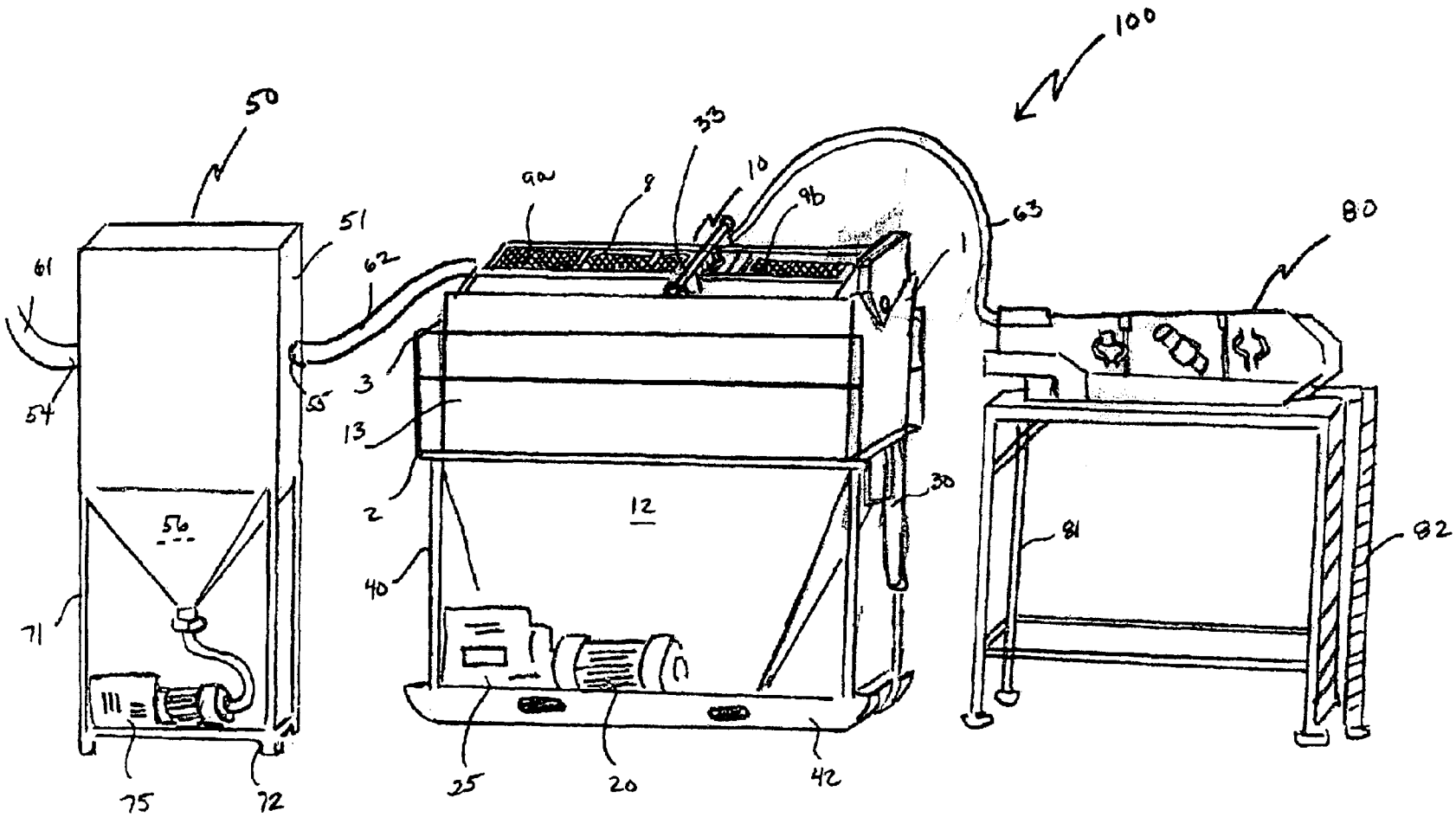
FIG. 3 perspective view of the recovery system of the present invention including a transfer vessel, a recovery apparatus and a recovery shaker.

Referring now to FIG. 3, the present invention provides a polymer bead recovery system 100 comprising: a transfer vessel 50, a low profile recovery apparatus 10 with a hydrocyclone manifold 33 and a recovery shaker 80. The a transfer vessel 50 comprises a housing 51 having an inlet 54, an outlet 55 and an internal cavity 56, a first conduit 61 attached to the inlet 54 for connecting a collection pan from the shale shaker from the rig to the transfer vessel 50, a second conduit 62 attached to the outlet 55 for connecting the transfer vessel 50 to a recovery apparatus 10, and the transfer vessel 50 comprising at least one pump 75. The transfer vessel 50 comprises a stand 71 and a built-in skid 72 for easy mobility and transportability of the transfer vessel 50 at the excavation site.

The recovery apparatus 10 comprises a housing 1 having a recovery tank 12 having an internal cavity and an exterior surface 13, the recovery tank 12 having at least one inlet 14 and at least one outlet 15, the recovery apparatus 10 having at least one device 20 for creating a force within the internal cavity of the recovery tank 12, the housing 1 further comprising a walkway 2 situated on the exterior surface 13 of the recovery tank 12, the recovery tank 12 comprising a shaker deck 8, the shaker deck 8 comprising at least two interchangeable screens 9 and the walkway 2 providing access to the screens 9; and a hydrocyclone manifold 33. In one embodiment, the recovery apparatus has the following dimensions: 7 feet in width×9 feet in length×8 feet in height and the recovery tank is 34 barrels in volume. In another embodiment, the recovery apparatus of the system of the present invention has a walkway that is 18 inches wide. In still another embodiment, the first screen in the shaker deck is 4 to 10 mesh and the second screen in the shaker deck is 140 to 325 mesh.

The recovery apparatus 10 further comprises a motor control panel 30 and a recovery pump 25. The walkway 2 comprises handrails 3 and a ladder 4 with steps situated on the exterior surface 13 of the recovery tank 12. The apparatus 10 further comprises a height adjustable stand 40 and a built-in skid 42 for easily transporting the apparatus 10 to the desired location. The recovery apparatus 10 is connected to a recovery shaker 80 by a conduit 63. The recovery shaker 80 comprises a stand 81, at least one staircase 82 and at least one screen (not shown).

The transfer vessel 50 transfers a mixture of solid particulate material, drilling fluids, polymer beads and drilled solids to a first screen 9*a* of the shaker deck 8 of the recovery apparatus 10 and wherein large solid particulate materials and drilled solids are separated from the mixture and discarded, and the remaining mixture is then deposited into the internal cavity of the recovery apparatus 10 and then the remaining mixture goes through the hydrocyclone manifold 33 where the component of the mixture are separated by specific gravity and the force created by the hydrocyclone manifold 33, and an underflow and an overflow are created, the underflow is then directed through a second screen 9*b* of the shaker deck 8 and is discarded, and the overflow containing the polymer beads are transferred to a recovery shaker 80 where the polymer beads are isolated and recovered.

In a further embodiment, the recovery system of the present invention comprises at least two centrifugal agitation lines; 4 inch overflow lines with vents that are 12 inches off the bottom of the recovery tank; three 4 inch 50 gallon per minute hydrocyclone manifolds; and 8 inch rig troughs that are pre-made for easy rig up on land rigs. In yet a further embodiment, the recovery shaker has at least two screens; the first screen being 100–325 mesh and the second screen being 140–325 mesh. The system further comprises wedge locks for preventing the loss of fluids, beads and solids through the screen frame. In another embodiment, the recovery unit is pre-wired for fast rig up with plugs and receptacles. In another embodiment, the system of the present invention may comprise of two transfer vessels; a first transfer vessel 50 being attached to the recovery apparatus 10 and a second transfer vessel (not shown) being attached to the recovery shaker 80.

Figure 4:
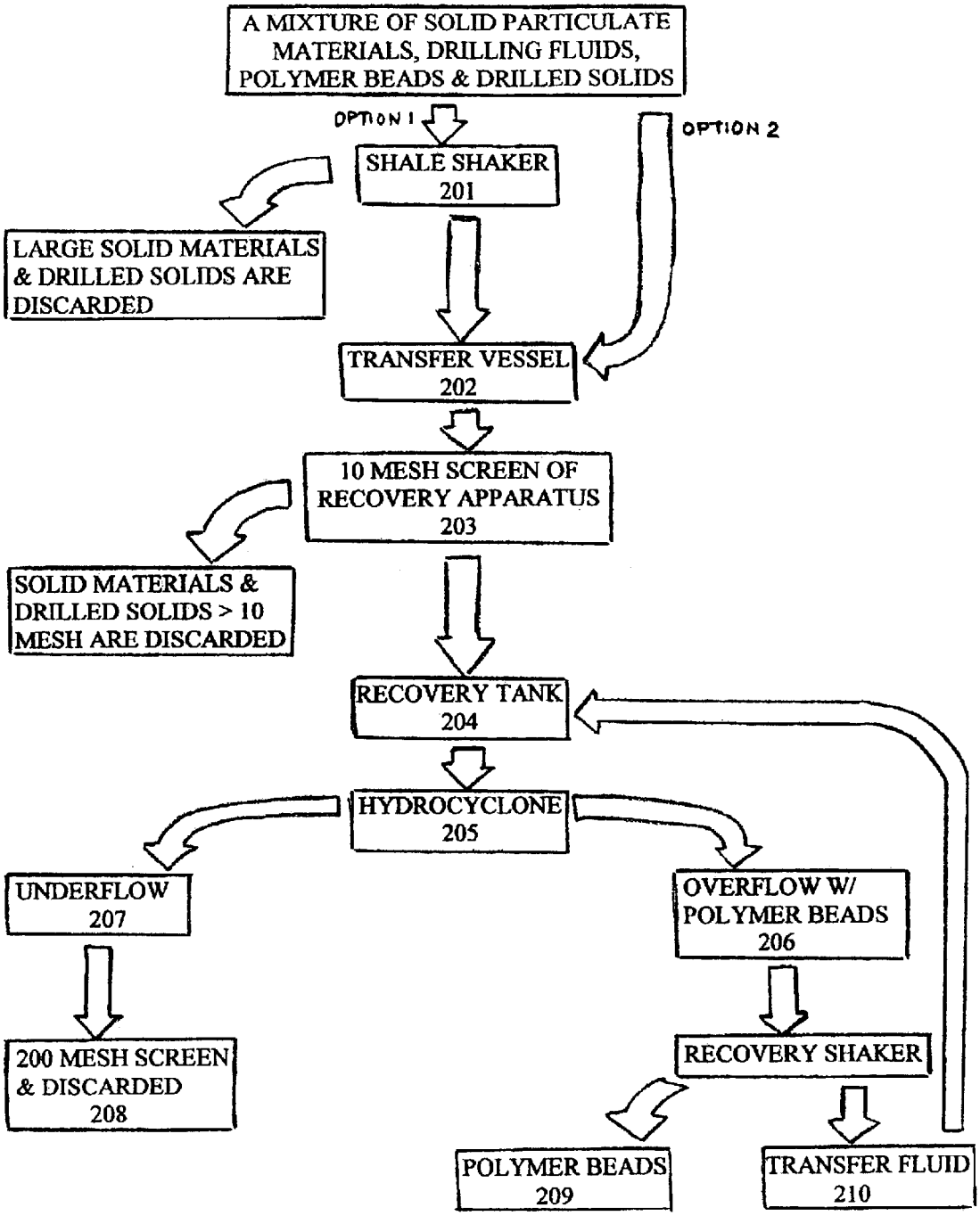
FIG. 4 depicts a schematic diagram of one of the embodiments of the recovery method of the present invention.

FIG. 4 depicts a schematic diagram showing how one embodiment of the polymer bead recovery method of the present invention works. A mixture of solid particulate material, drilling fluids, polymer beads and drilled solids from a rig is collected and goes over a first shale shaker 201 where large solid material and drilled solids are discarded (Option 1). The remaining mixture is then transported to the transfer vessel wherein the turbulence created by the transfer vessel pump separates the polymer beads that are attached to the drilled solids and cuttings 202. In another embodiment, the mixture goes directly to the transfer vessel 202 where the beads are separated from the solid particulate materials and drilled solids, and the large solid particulate materials and drilled solids are removed by the first screen in the recovery apparatus 203 and never enter the recovery tank (Option 2).

The mixture is then transferred onto the first screen (which a 10 mesh screen) of the shaker deck of the recovery apparatus in order that solid particulate materials and drilled solids larger than 10 mesh are separated from the mixture and discarded 203. The remaining mixture (without any large solid particulate materials and drilled solids) that has components smaller than 10 mesh enters the internal cavity of the recovery tank 204. The mixture is then transported to the hydrocyclone manifold 205 by the recovery pump where the components of the mixture are separated by specific gravity and the force created by said hydrocyclone manifold, and an overflow 206 and an underflow 207 are created. In one embodiment, the hydrocyclone manifold functions as a cleaning mechanism for the polymer beads. The underflow, which contains components of the mixture having a specific gravity greater than 1 are then transported to a 200 mesh screen and subsequently discarded 208. A 200 mesh screen is used in this embodiment because the 200 mesh functions to keep solids from building up in the tank so the liquid in the recovery tank does not become so viscous that it cannot be pumped out of the tank.

The overflow contains the transport fluid and the polymer beads, both having a specific gravity of 1 (or less than 1). The overflow goes through a recovery shaker where the polymer beads are isolated and recovered 209 and the transport fluid may be recycled back into the system and re-deposited into the drilling fluid 210.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A polymer bead recovery apparatus comprising:

a housing comprising a low-profile and portable recovery tank having an internal cavity and an exterior surface, said recovery tank having at least one inlet and at least one outlet, said recovery apparatus having at least one device for creating a force within said internal cavity of said recovery tank, said housing further comprising a walkway situated on the exterior surface of said recovery tank, said recovery tank comprising a shaker deck, said shaker deck comprising a plurality of interchangeable screens and said walkway providing access to said screens, said recovery tank further comprising an opening on its topside, said opening leading into said internal cavity and said shaker deck being situated on said topside of said recovery tank thereby covering at least a portion of said opening, said shaker deck being integrally constructed to said recovery tank and said screens of said shaker deck substantially covering the topside of said recovery tank;

wherein a mixture of solid particulate material, drilling fluids, polymer beads and drilled solids are separated by a first screen of said shaker deck and the remaining mixture of small materials, fluids and beads enters said recovery tank and are further separated by the force created by said device, the undesired small particulate materials are removed from said recovery tank and then separated and isolated by a second screen of said shaker deck, and then the polymer beads are isolated and then recovered and collected.

2. The recovery apparatus of claim 1 wherein said screens comprise mesh sizes from about 10 mesh to about 200 mesh.

3. The recovery apparatus of claim 1 wherein said recovery tank comprises at least two screens with varying screens sizes.

4. The recovery apparatus of claim 3 wherein a first screen has a mesh size from about 10 to about 40 mesh, and a second screen has a mesh size from about 60 to about 200 mesh.

5. The recovery apparatus of claim 1 wherein said recovery apparatus further comprises a motor control panel and said device comprises a recovery pump.

6. The recovery apparatus of claim 1 wherein said recovery tank comprises a plurality of collection vessels situated at a base of said recovery tank.

7. The recovery apparatus of claim 1 wherein said walkway comprises handrails and at least one ladder having steps situated on said exterior surface of said recovery tank.

8. The recovery apparatus of claim 4 further comprises a hydrocyclone manifold.

9. The recovery apparatus of claim 8 wherein said hydrocyclone manifold is situated above said second screen.

10. The recovery apparatus of claim 9 wherein said shaker deck is situated above said internal cavity of said recovery tank.

11. A polymer bead recovery system comprising:

a transfer vessel comprising a housing having an inlet, an outlet and an internal cavity, a first conduit attached to said inlet for connecting a shale shaker from a rig to said vessel, a second conduit attached to said outlet for connecting said vessel to a recovery apparatus, and said transfer vessel comprising at least one pump; and said recovery apparatus comprising a housing comprising a low-profile and portable recovery tank having an internal cavity and an exterior surface, said recovery tank having at least one inlet and at least one outlet, said recovery apparatus having at least one device for creating a force within said internal cavity of said recovery tank, said housing further comprising a walkway situated on the exterior surface of said recovery tank, said recovery tank comprising a shaker deck, said shaker deck comprising at least two interchangeable screens and said walkway providing access to said screens, said recovery tank further comprising an opening on its topside, said opening leading into said internal cavity and said shaker deck being situated on said topside of said recovery tank thereby covering at least a portion of said, opening, said shaker deck being integrally constructed to said recovery tank and said screens of said shaker deck substantially covering the topside of said recovery tank; and a hydrocyclone manifold;

wherein said transfer vessel transfers a mixture of solid particulate material, drilling fluids, polymer beads and drilled solids to said first screen of said shaker deck of said recovery apparatus and wherein large solid particulate materials and drilled solids are separated from the mixture and discarded, and the remaining mixture is then deposited into said internal cavity of said recovery apparatus and then the remaining mixture goes through said hydrocyclone manifold where the component of the mixture are separated by specific gravity and the force created by said hydrocyclone manifold, and an underflow and an overflow are created, the underflow is then directed through said second screen of said shaker deck and the remaining undesired materials are discarded, and the overflow containing the polymer beads are transferred to a recovery shakers where the polymer beads are isolated and recovered.

12. The recovery system of claim 11 wherein said recovery tank further comprises at least one dump valve for disposing of drilled solids from a base of paid tank.

13. The recovery system of claim 11 wherein said recovery tank comprises at least two screens with varying screens sizes, at least one screen has a mesh size from about 10 to about 40 mesh, and at least one screen has a mesh size from about 60 to about 200 mesh.

14. The recovery system of claim 13 wherein said screens comprise mesh sizes from about 10 mesh to about 200 mesh.

15. The recovery system of claim 11 wherein said recovery tank comprises a plurality of collection vessels situated at a base of said tank.

16. The recovery system of claim 11 wherein said walkway comprises handrails and at least one ladder having steps situated on said exterior surface of said recovery tank.

17. The recovery system of claim 11 further comprises at least one shale shaker connected to said transfer vessel and at least one recovery shaker connected to said recovery apparatus, said system comprising a plurality of conduits for connecting said shale shaker to said transfer vessel to said recovery apparatus and to said recovery shaker.

18. The recovery system of claim 17 wherein said shaker deck is situated above said internal cavity of said recovery tank.

* * * * *